US007521909B2

(12) United States Patent
Dow et al.

(10) Patent No.: US 7,521,909 B2
(45) Date of Patent: Apr. 21, 2009

(54) LINEAR REGULATOR AND METHOD THEREFOR

(75) Inventors: Stephen W. Dow, Austin, TX (US); Praveen Manapragada, Round Rock, TX (US); David F. Moeller, Buda, TX (US)

(73) Assignee: Semiconductor Components Industries, L.L.C., Phoenix, AZ (US)

( * ) Notice: Subject to any disclaimer, the term of this patent is extended or adjusted under 35 U.S.C. 154(b) by 435 days.

(21) Appl. No.: 11/403,979

(22) Filed: Apr. 14, 2006

(65) Prior Publication Data

US 2007/0241730 A1 Oct. 18, 2007

(51) Int. Cl.
*G05F 1/40* (2006.01)

(52) U.S. Cl. ..... 323/280; 323/274

(58) Field of Classification Search ..... 323/315, 323/316, 273–278, 280
See application file for complete search history.

(56) References Cited

U.S. PATENT DOCUMENTS

| | | | | |
|---|---|---|---|---|
| 6,300,749 | B1 | 10/2001 | Castelli et al. | 323/273 |
| 6,333,623 | B1 * | 12/2001 | Heisley et al. | 323/280 |
| 6,522,111 | B2 * | 2/2003 | Zadeh et al. | 323/277 |
| 6,556,083 | B2 | 4/2003 | Kadanka | 330/292 |
| 6,690,147 | B2 * | 2/2004 | Bonto | 323/280 |
| 7,405,546 | B2 * | 7/2008 | Amrani et al. | 323/273 |

* cited by examiner

*Primary Examiner*—Jessica Han
(74) *Attorney, Agent, or Firm*—Robert F. Hightower

(57) ABSTRACT

In one embodiment, a linear regulator is formed with a variable miller compensation circuit that varies a zero of the linear regulator proportionally to a load current supplied by the regulator.

17 Claims, 2 Drawing Sheets

LINEAR REGULATOR AND METHOD THEREFOR

BACKGROUND OF THE INVENTION

The present invention relates, in general, to electronics, and more particularly, to methods of forming semiconductor devices and structure.

In the past, the semiconductor industry utilized various methods and structures for forming linear voltage regulator circuits. One particular implementation of a linear voltage regulator circuit was referred to as a low drop-out (LDO) regulator. Such LDO regulators generally dropped a very small voltage across the regulator and provided a well regulated voltage to a load that was external to the LDO regulator. Under most conditions, the amount of current required by the load varied during the operation of the load. These variations affected the frequency stability of the system. As the load current varied, the impedance provided by the load also varied. These load impedance variations often caused unstable operation of the closed loop system formed by the LDO regulator and the load.

Accordingly, it is desirable have a method of forming a regulator with an internal compensation that improves the stability provided by the regulator.

For simplicity and clarity of the illustration, elements in the figures are not necessarily to scale, and the same reference numbers in different figures denote the same elements. Additionally, descriptions and details of well-known steps and elements are omitted for simplicity of the description. As used herein current carrying electrode means an element of a device that carries current through the device such as a source or a drain of an MOS transistor or an emitter or a collector of a bipolar transistor or a cathode or anode of a diode, and a control electrode means an element of the device that controls current through the device such as a gate of an MOS transistor or a base of a bipolar transistor. Although the devices are explained herein as certain N-channel or P-Channel devices, a person of ordinary skill in the art will appreciate that complementary devices are also possible in accordance with the present invention. It will be appreciated by those skilled in the art that the words during, while, and when as used herein are not exact terms that mean an action takes place instantly upon an initiating action but that there may be some small but reasonable delay, such as a propagation delay, between the reaction that is initiated by the initial action.

DETAILED DESCRIPTION OF THE DRAWINGS

Figure 1:
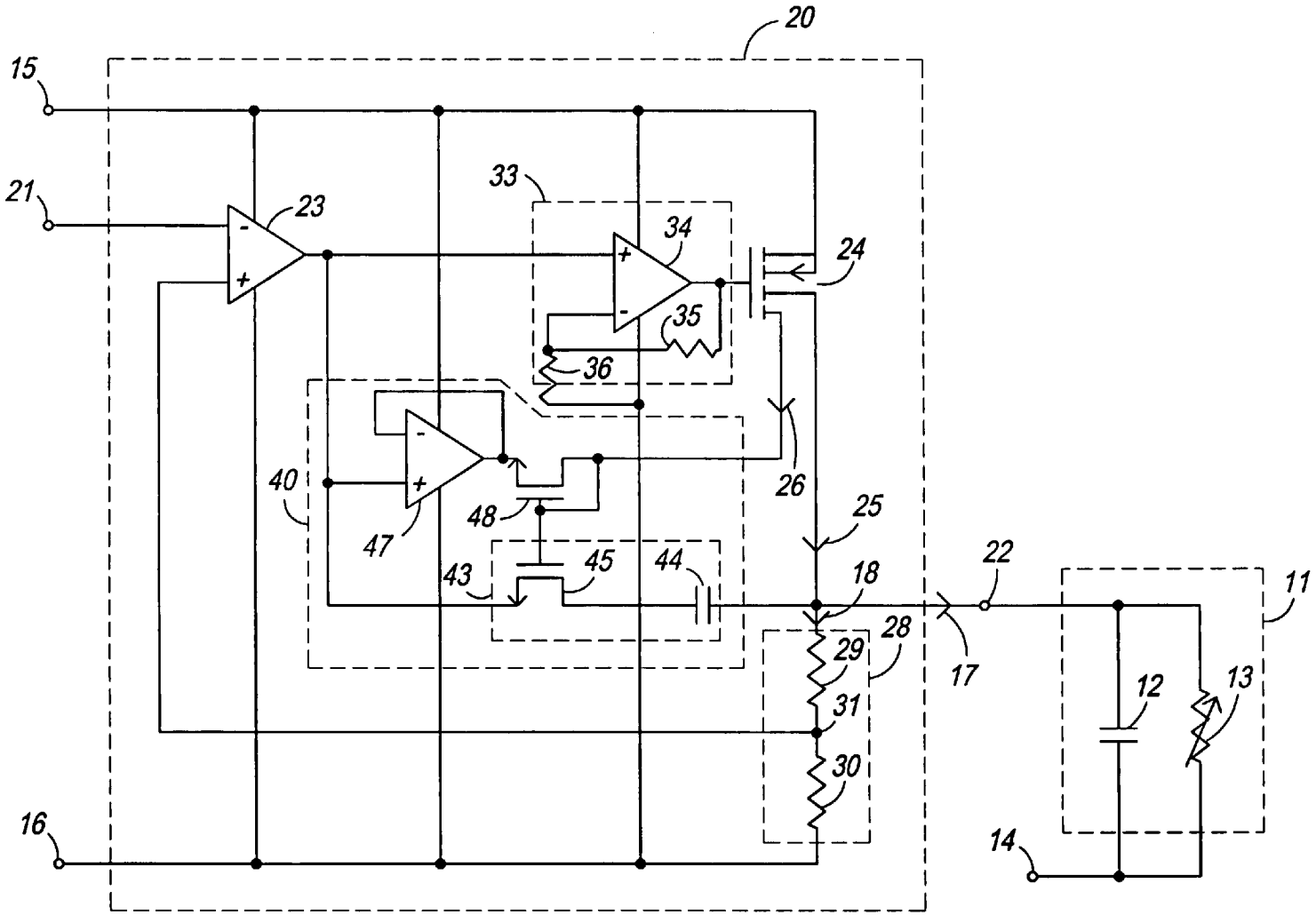
FIG. 1 schematically illustrates an embodiment of a portion of a system that includes a linear regulator in accordance with the present invention.

FIG. 1 schematically illustrates an embodiment of a portion of a regulator system 10 that includes a linear regulator 20. Regulator 20 includes an variable miller compensation circuit that is configured to form a compensation zero that moves in frequency proportional to variations in a load current supplied by regulator 20 thereby increasing the stability of system 10. The variable miller compensation circuit is configured to include a variable resistance that varies in value responsively to variations in the load current thereby forming the compensating zero. Regulator 20 typically receives power from a DC voltage source between a voltage input 15 and a voltage return 16. A load 11 generally is connected to an output 22 of regulator 20 to receive a regulated voltage and a load current 17 from output 22. Load 11 presents an impedance (Zload) that is represented by a capacitor 12 and a variable resistor 13. Load 11 generally has a return 14 that is connected to a common reference point such as return 16. Regulator 20 includes an error amplifier 23, a buffer driver or buffer 33, a pass element such as a transistor 24, a sense network 28, and a variable miller compensation circuit 40. The exemplary embodiment of circuit 40 illustrated in FIG. 1 includes an amplifier 47, a matching transistor 48, and a variable miller compensation network 43 that includes a variable resistance formed by a transistor 45 and a compensation capacitor 44. Error amplifier 23 generally is configured as a transconductance amplifier that has gain elements connected thereto to form a desired gain for amplifier 23. The exemplary form of network 28 illustrated in FIG. 1 is a resistor divider that includes resistors 29 and 30 connected in series between output 22 and return 16. Resistors 29 and 30 form an output voltage sense signal on a node 31 at a common connection between resistors 29 and 30. However, network 28 may have other implementations as long as the implementation forms the output voltage sense signal that is representative of the value of the output voltage on output 22. Transistor 24 is formed to include a main transistor and a sense transistor that forms a sense current 26 that is representative of a current 25 though the main transistor of transistor 24. One example of such a transistor is referred to as a SenseFET type of transistor. The size of the sense transistor is ratioed to the size of the main transistor so that the value of sense current 26 is proportional to the value of the current through the main transistor. SENSEFET is a trademark of Motorola, Inc. of Schaumburg, Ill. One example of a SENSEFET type of transistor is disclosed in U.S. Pat. No. 4,553,084 issued to Robert Wrathall on Nov. 12, 1985, which is hereby incorporated herein by reference. Those skilled in the art will appreciate that transistor 24 may be other types of ratioed transistors as long as the transistor forms a sense current that is representative of the current through the main transistor.

Error amplifier 23 receives a reference signal from a reference input 21 of regulator 20 and also receives the voltage sense signal from node 31. Amplifier 23 forms an error signal on an output of amplifier 23 that represents the deviation of the sense signal from the reference signal. Buffer 33 receives the error signal and forms a drive signal that controls transistor 24 to provide current 25. In the preferred embodiment, buffer 33 is formed as a differential amplifier 34 having a gain that is selected by the value of gain resistors 35 and 36. The gain of buffer 33 generally is greater than one in order to drive transistor 24 and preferably is about five. A portion of current 25 from transistor 24 flows through network 28 as current 18 to provide the voltage sense signal and the remainder flows through output 22 as a load current 17. Since the amount of current flowing through network 28 is very small relative to the value of current 17, the value of current 25 flowing through transistor 24 is substantially equal to the value of current 17, thus, the value of sense current 26 is substantially proportional to the value of load current 17.

The various capacitances and resistances of regulator 20 and system 10 form poles and zeroes that affect the stability of regulator 20 and system 10. Transistor 24 has a large gate-to-source parasitic capacitance that forms a parasitic pole of regulator 20. Buffer 33 usually has a high input impedance and a low output impedance that isolates the parasitic capacitance of transistor 24 from the output impedance of amplifier 23. The low output impedance of buffer 33 places the parasitic pole at a high-frequency that is outside the active frequency range of system 10. Compensation capacitor 44 forms a dominant pole of regulator 20 and system 10. The frequency of the dominant pole of capacitor 44 is controlled by the output resistance of amplifier 23 times the effective value of capacitor 44. Because capacitor 44 is connected in parallel with buffer 33 and transistor 24 in a miller configuration, the effective capacitance of capacitor 44 is the physical value of capacitor 44 times the gain provided by buffer 33 and transistor 24. The miller configuration makes the effective value of capacitor 44 large thereby placing the dominant pole at a low frequency. A load pole is formed by the capacitance of load 11 illustrated by capacitance 12. The frequency of the load pole is determined by capacitance 12 and the load resistance illustrated by resistor 13. Since the value of load current 17 varies during the operation of load 11, the effective value of resistor 13 also varies with the variations in current 17. Thus, the frequency of the load pole also varies with variations in current 17. As will be seen further hereinafter, circuit 40 is connected in a miller configuration in parallel with buffer 33 and transistor 24 so that the variable resistance of transistor 45 is connected in series with capacitor 44 and the series combination thereof is connected in parallel with the gains of buffer 33 and transistor 24.

Figure 2:
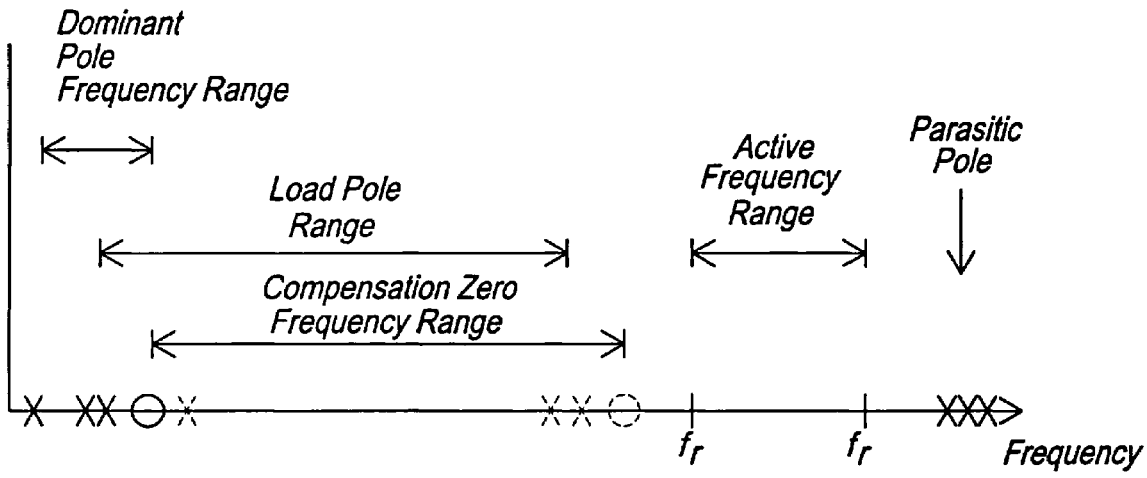
FIG. 2 is a graph illustrating a frequency diagram for a portion of the linear regulator system of FIG. 1 in accordance with the present invention.

FIG. 2 is a graph illustrating a frequency diagram of some of the poles and zeros of system 10. The frequency diagram is a one-dimensional illustration, thus, the abscissa indicates increasing frequency and the ordinate is not used. The dominant pole is illustrated by a single X mark (X), the load pole is illustrated by a two X marks (XX), the parasitic pole is illustrated by three X marks (XXX), the compensation zero is illustrated by a circle (○), and the active frequency range is illustrated by the symbol $f_r$. The frequency of the poles and zeros under light load conditions (low values of current 17) are illustrated by solid forms of the marks and under heavy load conditions (high values of current 17) by dashed versions of the marks. Circuit 40 is configured to position the compensation zero proximate in frequency to the frequency of the load pole at light load conditions and to substantially track the frequency variations of the load pole during the operation of system 10 in order to maintain the stability of system 10. The resistance of transistor 45 and the capacitance of capacitor 44 form the compensation zero. Transistor 45 is configured to function as a variable resistor that moves the frequency of the compensation zero. Amplifier 47 receives the error signal from amplifier 23 and forms a buffered error signal that is representative of the value of the error signal. Amplifier 47 preferably is a unity gain buffer so that the buffered error signal is substantially equal to the error signal. Amplifier 47 generally is configured as a transconductance amplifier having gain elements that set the gain for amplifier 47. Diode connected transistor 48 receives the buffered error signal and sense current 26 which forces a gate-to-source voltage (Vgs) for transistor 48. Because the gate of transistor 45 is connected to the gate of transistor 48 and the source of transistor 45 receives substantially the same signal as the source of transistor 48, the gate-to-source voltage (Vgs) of transistor 45 is forced to be substantially equal to the Vgs of transistor 48. Thus, transistor 45 has a finite Vgs but the drain of transistor 45 is connected to capacitor 44 so there is no DC current through transistor 45. This biasing condition forces the drain-to-source voltage (Vds) of transistor 45 to be substantially zero. Because Vds is less than Vgs, transistor 45 functions as a resistor. As the Vgs of transistor 45 changes in value, the resistance of transistor 45 also changes in value. The Vgs of transistor 45 is controlled by the Vgs of transistor 48 which is controlled by the value of current 26. Thus, as the value of current 17 changes the resistance of transistor 45 changes thereby changing the frequency of the compensation zero. It is believed that the dominant pole formed by capacitor 44 generally is positioned at a frequency of less than about ten hertz and preferably is no greater than about one Hertz. The dominant pole frequency usually varies no greater than about a factor of ten over the operating range of regulator 20. It is also believed that the compensation zero tracks the load pole within less than about five percent (5%) during the operation of system 10. The goal is to configure amplifiers 23 and 47 and transistors 45 and 48 so that the Vgs of transistor 45 is equal to the Vgs of transistor 48. However, as is well known in the art there are always minor variances that prevent the gains from being identically equal. It is well established in the art that variances of up to about ten percent (10%) are regarded as reasonable variances from the ideal goal of exactly equal.

In order to assist and providing this functionality, amplifiers 23, 34, and 47 are connected to receive power between input 15 and return 16. An inverting input of amplifier 23 is connected to input 21 and a non-inverting input of amplifier 23 is connected to node 31. The output of amplifier 23 is commonly connected to a non-inverting input of amplifier 34, a non-inverting input of amplifier 47, and a source of transistor 45. An inverting input of amplifier 34 is commonly connected to a first terminal of resistor 35 and a first terminal of resistor 36. A second terminal of resistor 36 is connected to return 16. A second terminal of resistor 35 is commonly connected to an output of amplifier 34 and a gate of transistor 24. A source of transistor 24 is connected to input 15. The drain of transistor 24 is connected to output 22 and to a first terminal of capacitor 44. The sense drain of transistor 24 is commonly connected to a gate and a drain of transistor 48 and to a gate of transistor 45. The source of transistor 48 is commonly connected to an output and an inverting input of amplifier 47. A drain of transistor 45 is connected to a second terminal of capacitor 44. A first terminal of resistor 29 is connected to output 22 and a second terminal is commonly connected to node 31 and a first terminal of resistor 30. A second terminal of resistor 30 is connected to return 16.

Figure 3:
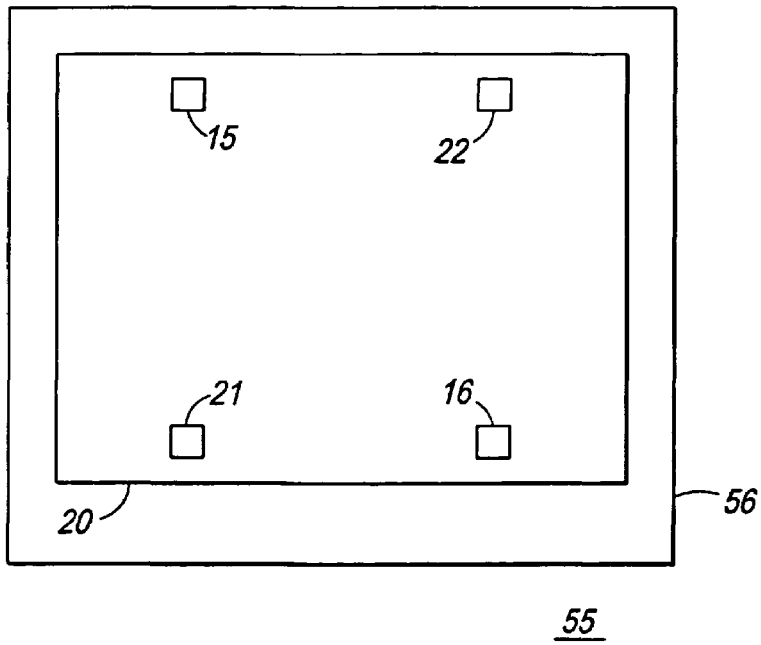
FIG. 3 schematically illustrates an enlarged plan view of a semiconductor device that includes the linear regulator of FIG. 1 in accordance with the present invention.

FIG. 3 schematically illustrates an enlarged plan view of a portion of an embodiment of a semiconductor device or integrated circuit 55 that is formed on a semiconductor die 56. Regulator 20 is formed on die 56. Die 56 may also include other circuits that are not shown in FIG. 3 for simplicity of the drawing. Regulator 20 and device or integrated circuit 55 are formed on die 56 by semiconductor manufacturing techniques that are well known to those skilled in the art. In one embodiment, controller 20 is formed on a semiconductor substrate as an integrated circuit having four external leads connected to input 15, return 16, input 21, and output 22.

In view of all of the above, it is evident that a novel device and method is disclosed. Included, among other features, is forming linear regulator having a variable miller compensation circuit that is in series with an output amplifier of the regulator, such as amplifier 34. Configuring the variable miller compensation circuit in parallel with the output amplifier increases the effective capacitance thereby placing the resulting pole at a very low frequency that has very little variation. Configuring the variable miller circuit to include a resistance that varies proportionally to a load current forms the resulting zero with a frequency that varies with the load current. Varying the frequency with the load current keeps the zero close to the load pole and improves the stability of the system that uses the linear regulator.

While the subject matter of the invention is described with specific preferred embodiments, it is evident that many alternatives and variations will be apparent to those skilled in the semiconductor arts. For example, although regulator 20 is illustrated as a stand-alone circuit, it will be appreciated by those skilled in the art that regulator 20 may be formed on a semiconductor die as one portion of an integrated circuits having various other components that may also be formed on the semiconductor die. Additionally, the control elements of the variable miller compensation circuit, such as amplifier 47 and transistor 48, can be implemented by other circuit elements that are coupled to vary the resistance of transistor 45 as long as the variable resistance and the capacitance are coupled in a miller configuration. Also, the subject matter of the invention has been described for particular P-channel transistors, the method is directly applicable to other MOS transistors, as well as to BiCMOS, metal semiconductor FETs (MESFETs), HFETs, and other transistor structures. Additionally, the word "connected" is used throughout for clarity of the description, however, it is intended to have the same meaning as the word "coupled". Accordingly, "connected" should be interpreted as including either a direct connection or an indirect connection.

The invention claimed is:

1. A linear regulator comprising:

an output amplifier configured to supply a load current to a load that is external to the linear regulator;

an error amplifier coupled to form an error signal to control the output amplifier and regulate a value of an output voltage supplied to the load; and a miller compensation circuit coupled in parallel with the output amplifier wherein the miller compensation circuit includes a variable resistance and is configured to vary a resistance of the miller compensation circuit responsively to variations in the load current, the miller compensation circuit also including a capacitor coupled in series with the variable resistance wherein the series combination is connected in parallel with the output amplifier and wherein a first terminal of the capacitor is coupled to an output of the output amplifier.

2. The linear regulator of claim 1 wherein the miller compensation circuit includes an amplifier coupled to receive the error signal and form a first signal that is representative of the error signal and also includes a first transistor coupled to receive a sense signal that is representative of the load current, to receive the first signal, and responsively form a control voltage.

3. The linear regulator of claim 2 wherein the first transistor is coupled in a diode configuration and wherein the variable resistance is a second transistor having a control electrode coupled to the control electrode of the first transistor.

4. The linear regulator of claim 2 wherein a first terminal of the variable resistance is coupled to receive the error signal and a control terminal is coupled to receive the control voltage.

5. The linear regulator of claim 1 wherein the output amplifier includes a buffer amplifier and a drive transistor.

6. The linear regulator of claim 1 wherein the error amplifier is coupled to receive a sense signal that is representative of the output voltage and control the value of the output voltage responsively to the sense signal.

7. A method of forming a linear regulator comprising:

coupling a miller compensation network in parallel with an output amplifier of the linear regulator; and configuring the miller compensation network to vary a resistance of the miller compensation network responsively to variations of a load current through an output of the linear regulator including coupling a first transistor to receive a current that is representative of the load current, to receive an error signal from an error amplifier of the linear regulator, and form a control signal that varies responsively to variations in the load current.

8. The method of claim 7 wherein coupling the miller compensation network in parallel with the output amplifier includes coupling a variable resistance in series with a capacitor and coupling the series combination in parallel with the output amplifier.

9. The method of claim 8 wherein coupling the variable resistance in series with the capacitor includes coupling a first terminal of the capacitor to an output of the output amplifier and a second terminal to the variable resistance.

10. The method of claim 9 further including a second terminal of the variable resistance to receive the error signal from the error amplifier of the linear regulator.

11. The method of claim 7 further including coupling a control electrode of a second transistor to receive the control signal, coupling a first current carrying electrode of the second transistor to receive the error signal, and coupling a second current carrying electrode of the second transistor to a capacitor.

12. A linear regulator comprising:

an output amplifier configured to supply a load current to a load;

an error amplifier configured to form an error signal to control the output amplifier;

a capacitor having a first terminal coupled to an output of the output amplifier, and a second terminal; and a variable resistance configured to vary a resistance of the variable resistance responsively to the load current, the variable resistance coupled in series with the capacitor and having a first terminal coupled to receive the error signal wherein the series combination of the variable resistance and the capacitor is coupled in parallel with the output amplifier.

13. The linear regulator of claim 12 further including an amplifier coupled to receive the error signal and form a first signal representative of the error signal; a first transistor coupled to receive the first signal, coupled to receive a sense signal that is representative of the load current, and responsively form a control signal; and the variable resistance coupled to receive the control signal and responsively vary a resistance of the variable resistance.

14. The linear regulator of claim 13 wherein the variable resistance includes a second transistor having a control electrode coupled to receive the control signal, a first current carrying electrode coupled to receive the error signal, and a second current carrying electrode coupled to the second terminal of the capacitor.

15. The linear regulator of claim 13 wherein the output amplifier includes an output transistor coupled to form the load current and a ratio transistor that is ratioed to the output transistor wherein the ratio transistor forms the sense signal that is representative of the load current, the output transistor having a gain, the ratio transistor having a control electrode and a first current carrying electrode coupled to a respective control electrode and first current carrying electrode of the output transistor.

16. The linear regulator of claim 15 wherein the output amplifier also includes an amplifier coupled to receive the error signal and form a drive signal that is representative of the error signal, the output transistor coupled to receive the drive signal.

17. The linear regulator of claim 12 wherein the output amplifier includes a buffer amplifier and an output transistor.

* * * * *